United States Patent [19]

Thompson et al.

[11] Patent Number: 4,637,340

[45] Date of Patent: Jan. 20, 1987

[54] DEVELOPER METERING STRUCTURE

[75] Inventors: Michael D. Thompson, Rochester; Clifford W. Imes, IV, Williamson, both of N.Y.

[73] Assignee: Xerox Corporation, Stamford, Conn.

[21] Appl. No.: 737,951

[22] Filed: May 28, 1985

[51] Int. Cl.[4] ..... G03G 15/09

[52] U.S. Cl. ..... 118/657

[58] Field of Search ..... 118/657, 658

[56] References Cited

U.S. PATENT DOCUMENTS

| | | | |
|---|---|---|---|
| 4,188,907 | 2/1980 | Lipani | 118/657 |
| 4,227,796 | 10/1980 | Kamp et al. | 355/3 R |
| 4,265,990 | 5/1981 | Stolka et al. | 430/59 |

*Primary Examiner*—Bernard D. Pianalto

[57] ABSTRACT

A new and improved structure for metering the developer to a uniform thickness on a developer roll. To this end a magnetic steel shim or blade member is provided in the vicinity of a magnetic developer roll. The shape and location of the shim or blade member in the developer sump is such that a transport magnet (i.e. developer roll) rotatably supported adjacent the outlet of the sump causes vibration of the shim or blade due to the coupling and decoupling therebetween of the magnetic force fields created through the rotation of the developer roll. The developer which passes between the shim or blade member and the developer roll is freed of agglomerations and is metered to a predetermined thickness on the developer roll.

12 Claims, 2 Drawing Figures

DEVELOPER METERING STRUCTURE

BACKGROUND OF THE INVENTION

This invention relates to printing machines, and more particularly, to a toner development apparatus for developing latent electrostatic images on a charge-retentive surface and, more particularly, to an improved toner sump or storage area for dispensing single component magnetic developer for presentation to a magnetic developer roll which, in turn, presents the developer to a charge-retentive surface such as photoconductor.

In the art of xerography or other similar image reproducing arts, a latent electrostatic image is formed on a charge-retentive surface such as a photoconductor which generally comprises a photoconductive insulating material adhered to a conductive backing. The photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as developer or toner which forms the visible images is transferred to plain paper.

It should be understood that for the purposes of the present invention, which relates to the development of latent electrostatic images with developer or toner particles, the latent electrostatic image may be formed by means other than by the exposure of an electrostatically charged photosensitive member to a light image of an original document. For example, the latent electrostatic image may be generated from information electronically stored or generated in digital form which may afterwards be converted to alphanumeric images by image generation electronics and optics. However, such image generation electronic and optic devices form no part of the present invention.

Many acceptable techniques exist for applying developer; however, one general approach, which is often used commercially, it to attract particulate developer to an applicator surface and move the applicator into a transfer relation with the image member so that marking particles can adhere to the member in accordance with the image pattern. Most commonly, the applicator is a roller which rotates so that its peripheral surface moves between a developer supply location and a zone in transfer relation with the image member. Adherence of the developer to such applicator rollers can be accomplished in various ways including, e.g., adhesive or electrical attraction, but the most prevalent commercial technique utilizes magnetic attraction and applicators using this technique are often called magnetic brushes.

Developers used with such magnetic brushes can be single component (in which case toner is magnetically attractable) or comprise two components (in which case the toner particles are electrostatically attracted to magnetically attractable carrier particles in the developer mixture). The magnetic brush applicators can take various forms, however, a typical configuration comprises a non-magnetic outer cylinder which surrounds an array of magnets located within its inner periphery. Developer transport is effected by rotation of the outer cylinder and/or the interior magnet array.

In using such magnetic brushes (and in other applicators such as mentioned above), the uniformity of image-development often depends significantly upon control of the quantity and density (i.e., compactness) and uniformity of developer adhering to the applicator surface. Developer shortage can cause incomplete development and developer excess can cause scratching and other non-uniformities in the developed image. Developer shortage as well as excess can result from developer agglomeration.

Although single component developers offer many advantages over two component systems, many of these developers have a problem in that they tend to lump up or agglomerate in the developer sump to a greater degree than do two component developers. Also, it is difficult to meter the developer to the desired thickness on the developer roll.

The traditional technique for controlling brush thickness of such brushes has been a doctor blade that extends across the applicator surface and is spaced a uniform distance from the surface. Such doctor blade is located between the developer supply and the image member so as to trim off excess developer adhering to the roller. Thus, the blade is precisely positioned parallel to the transporting cylinder to form a predetermined gap which controls the amount or thickness of toner passing to the development zone. Proper blade positioning is critical and it is extremely difficult to achieve and maintain. An expensive mechanism is necessary if easy adjustment is needed. More often, compromises are made which make such blade difficult to adjust or not adjustable at all. In addition to the foregoing problems such blades necessarily cause unwanted compaction of the adhered developer, prior to its entering the development zone.

A method and apparatus for applying toner to a charge-retentive surface which purports to solve the problem of toner metering is disclosed and claimed in U.S. Pat. No. 4,227,796 issued in the name of Kamp et al and assigned to the Eastman Kodak Company. As disclosed therein, a coil spring is provided through which developer from a sump flows. The spring tension is adjustable to vary the flow rate therethrough and is mounted for rotation in order to break up an agglomerated developer as it passes through the spring.

The spring is mounted in intimate contact with the developer roll with which it is associated. It appears that the rotating coil spring acts like an auger of the type conventionally used in xerographic development and cleaning systems. Thus, the coils of the spring move through the developer while transporting it in the direction of the longitudinal axis of the developer roll to thereby uniformly distribute it on the surface of the the developer roll beyond the line of contact between the spring and the developer roll.

Structure similar to Applicant's invention is incorporated in the Model M10 copier machine by Ricoh Company, a Japanese Corporation. This machine was first introduced as a commercial product during the summer of 1984 which was subsequent to our invention and less than one year prior to the filing of a patent application on our invention. The developer apparatus of the Ricoh M10 machine utilizes a Mylar (Trademark of E. I. DuPont de Nemours & Co.) a blade for metering the developer onto a magnetic developer roll. The metering blade is fabricated from a ferromagnetic material and is mounted in intimate contact with the developer roll.

U.S. Pat. No. 4,188,907 discloses and claims a particle dispenser with a magnetically driven agitator immersed in developer particles. An oscillatory magnetic field created through the rotation of a roll magnet causes the agitator to vibrate to thereby preclude bridging and caking of the particles to improve the flow of the developer from the open end of a chamber.

SUMMARY OF THE INVENTION

In order to insure a uniform distribution of developer on the developer roll, we have provided new and improved structure for metering the developer to a uniform thickness on the developer roll. To this end there is disclosed hereinafter in greater detail a magnetic steel shim or blade member. The shape and location of the shim or blade member in the developer sump is such that a transport magnet (i.e., developer roll) rotatably supported adjacent the outlet of the sump causes vibration of the shim or blade member due to the coupling and decoupling therebetween of the magnetic force fields created through the rotation of the developer roll.

One important feature of our invention resides in the dimension of the shim or blade member. Therefore, the thickness (i.e., 0.03 inch) thereof is quite small relative to the width and length thereof, the latter being substantially coextensive with the length of the developer roll.

Another important aspect of our invention resides in the spaced-apart relationship between one edge of a shim or blade member and the developer roll. The shim or blade member is spaced from the developer roll a sufficient distance to allow the edge thereof to vibrate without actually contacting the developer roll.

The presence of the shim or blade in the magnetic field created by the rotation of the developer roll enhances the magnet forces of the magnetic field which assists the action of the shim or blade to both break up developer agglomerates and effect uniform metering of the developer on the developer roll as the developer passes between the edge of the shim or blade and the developer roll.

DETAILED DESCRIPTION OF THE DRAWINGS

Figure 1:
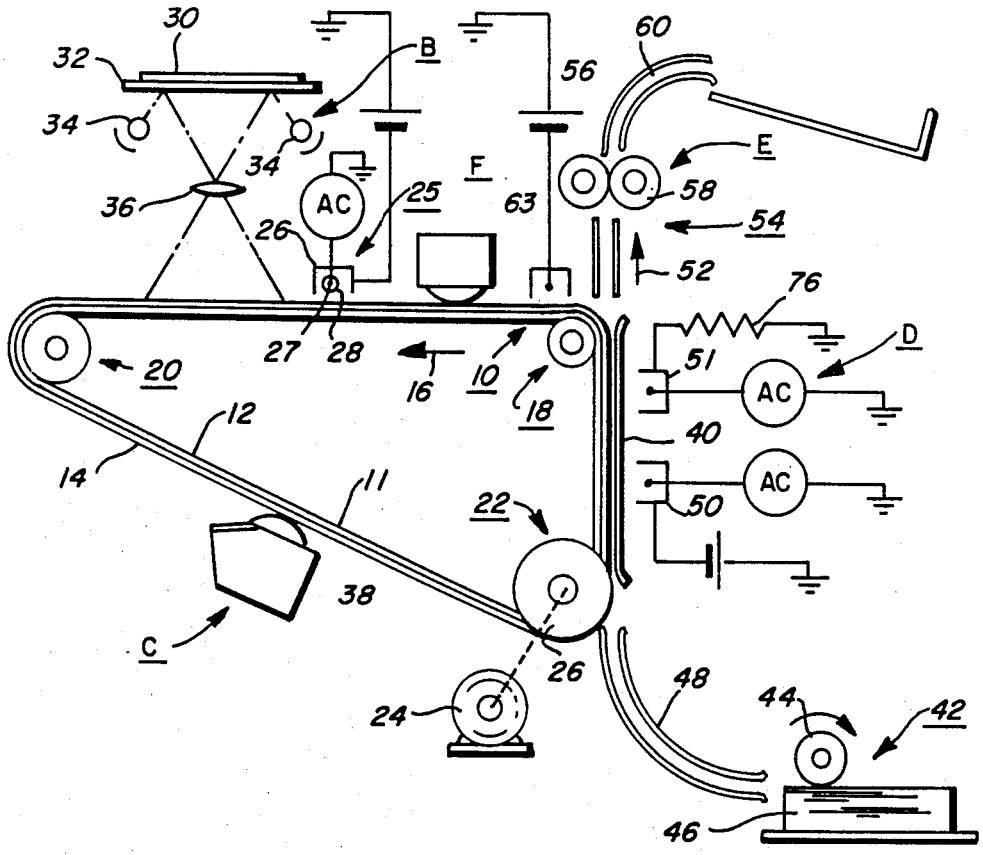
Figure 2:
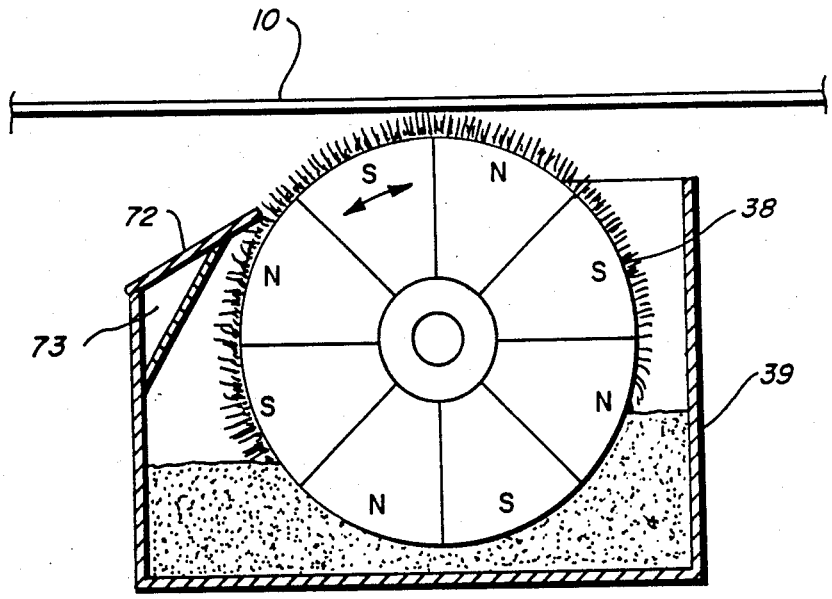

Other aspects of the present invention will become apparent as the following description proceeds with reference to the drawings wherein:

FIG. 1 is a schematic elevational view depicting an electrophotographic printing machine incorporating the present invention; and FIG. 2 is an enlarged schematic view of the developer apparatus of the present invention.

DETAILED DESCRIPTION OF THE INVENTION

Inasmuch as the art of electrophotographic printing is well known, the various processing stations employed in the printing machine illustrated in FIG. 1 will be described only briefly.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoconductive belt of the foregoing type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain. Belt 10 is maintained in tension by a pair of springs (not shown) which resiliently urge tension roller 20 against belt 20 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device indicated generally by reference numeral 25 charges the layer 12 of belt 10 to a relatively high, substantially uniform negative potential.

A suitable corona generating device for negatively charging the photoconductive belt 10 comprises a conductive shield 26 and corona wire 27, the latter of which is coated an electrically insulating layer 28 having a thickness which precludes a net dc corona current when an A.C. voltage is applied to the corona wire when the shield and photoconductive surface are at the same potential.

Next, the charged portion of the photoconductive belt is advanced through exposure station B. At exposure station B, an original document 30 is positioned face down upon a transparent platen 32. The light rays reflected from original document 30 form images which are transmitted through lens 36. The light images are projected onto the charged portion of the photoconductive belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 disposed in a developer housing or sump 39 advances developer into contact with the electrostatic latent image. The latent image attracts the developer particles from the developer roller or roll thereby forming visible images on the photoconductive belt. The developer roll 38 may comprise any conventional construction known in the art of printing.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the upper most sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder images are permanently affixed to sheet 40. After fusing, chute 60 guides the advancing sheet 40 to catch tray 62 for removal from the printing machine by the operator.

A preclean dicorotron 63 is provided for exposing the residual toner and contaminants to positive charges to thereby narrow the charge distribution thereon so that a negatively biased cleaning roller or brush 64, to be discussed hereinafter, will be more effective in removing them.

At the cleaning station F, residual toner and contaminants or debris such as paper fibers and Kaolin are removed from the photoreceptor surface by means of brush 64 which is preferably a captive magnetic brush structure which is negatively biased by means of a power source (not shown) and which is rotated in the direction of the arrow 66 via a motor (not shown). In a xerographic or similar type system of the type herein disclosed, the brush 64 will remove the residual toner from the photoreceptor.

As viewed in FIG. 2, the developer sump or housing 39 contains a quantity of single component developer 70. The developer roll 38 is rotatably supported in the sump such that it picks up developer particles to be presented to the photoconductive belt 10.

A blade member 72 is secured to the sump by means of a non-magnetic support 74 such that it is suspended in cantilever fashion so that a free end 74 thereof is spaced from the surface of the developer roll a distance of approximately 0.050 inch (1.25 mm). The blade member is fabricated from a soft magnetic material so that the magnetic forces created by the magnetic field emanating from the magnetic developer roll can cause vibration of the blade member. Such vibration serves to break agglomerations in the developer particles as well as meter the developer to the desired height on the developer on the developer roll. The spacing of the free end 74 is such that the end does not touch the developer roll and with the vibration of the blade member the distance of the free end to produce the desired developer height is maintained.

The blade member 72 preferably has a thickness of 0.030 inch (0.075 mm) and has a width that is substantially coextensive with the length of the developer roll 38. The length (i.e., the distance measured from the free end 74 to the opposite end thereof) is sufficient to permit the desired vibration.

We claim:

1. Printing apparatus for forming toner images on a charge-retentive surface which surface is moved past processing stations of the printing apparatus, said processing stations including a developer station where latent electrostatic images are rendered visible by the application of single component magnetic developer particles, said apparatus comprising:

developer apparatus positioned at said developer station and comprising a sump for containing a quantity of said single component magnetic developer;

a magnetic developer roll rotatably supported in said sump contiguous said charge-retentive surface whereby developer carried by said developer roll from said sump is presented to said charge-retentive surface; and a blade member supported adjacent said developer roll and spaced apart therefrom such that said blade member contacts developer material only after it has been attracted to said developer roll, said blade being fabricated from a soft magnetic material capable of being vibrated due to the influence of the forces created by the magnetic fields created by the rotation of said magnetic developer roll, the degree of vibration of said blade member being insufficient to cause said blade member to contact said developer roll whereby agglomerated developer carried by said developer roller is broken up and the developer is metered to a predetermined height on said developer roll.

2. Apparatus according to claim 1 wherein said blade member is, in its non-vibrating, spaced about 0.050 inch from the surface of said developer roll.

3. Apparatus according to claim 2 wherein said blade member is attached to said sump via a non-magnetic material.

4. Apparatus according to claim 3 wherein said blade member is supported in cantilever fashion such that its free end is adjacent to said developer roll.

5. Apparatus according to claim 1 wherein said blade member is approximately 0.030 inch thick.

6. Apparatus according to claim 4 wherein said blade member is approximately 0.030 inch thick.

7. Developer apparatus for rendering latent electrostatic images visible through the application of single component magnetic developer to a charge-retentive surface containing said latent images, said apparatus comprising:

a sump containing a quantity of single component magnetic developer;

a magnetic developer roll rotatably supported in said sump contiguous said charge-retentive surface whereby developer carried by said developer roll from said sump is presented to said charge-retentive surface; and a blade member supported adjacent said developor roll and spaced apart therefrom such that said blade member contacts developer material only after it has been attracted to said developer roll, said blade being fabricated from a soft magnetic material capable of being vibrated due to the influence of the forces created by the magnetic fields created by the rotation of said magnetic developer roll, the degree of vibration of said blade member being insufficient to cause said blade member to contact said developer roll whereby agglomerated developer carried by said developer roller is broken up and the developer is metered to a predetermined height on said developer roll.

8. Apparatus according to claim 7 wherein said blade member is, in its non-vibrating, spaced about 0.050 inch from the surface of said developer roll.

9. Apparatus according to claim 8 wherein said blade member is attached to said sump via a non-magnetic material.

10. Apparatus according to claim 9 wherein said blade member is supported in cantilever fashion such that its free end is adjacent to said developer roll.

11. Apparatus according to claim 7 wherein said blade member is approximately 0.030 inch thick.

12. Apparatus according to claim 11 wherein said blade member is approximately 0.030 inch thick.

* * * * *